United States Patent [19]

Guistina

[11] Patent Number: 4,656,966

[45] Date of Patent: Apr. 14, 1987

[54] METHOD AND APPARATUS FOR DEVELOPING ELECTROGRAPHIC IMAGES USES MOLECULAR SIEVE ZEOLITE

[75] Inventor: Robert A. Guistina, Rochester, N.Y.

[73] Assignee: Eastman Kodak Company, Rochester, N.Y.

[21] Appl. No.: 893,426

[22] Filed: Aug. 4, 1986

[51] Int. Cl.[4] ..... G03G 15/10

[52] U.S. Cl. ..... 118/661; 430/119; 430/137

[58] Field of Search ..... 430/119, 137; 118/661

[56] References Cited

U.S. PATENT DOCUMENTS

| | | | |
|---|---|---|---|
| 2,877,133 | 3/1959 | Mayer | 117/37 |
| 2,890,174 | 6/1959 | Mayer | 430/114 |
| 3,939,087 | 2/1976 | Vijayendran et al. | 430/114 |
| 3,976,583 | 8/1976 | Herrmann et al. | 430/114 |
| 3,983,045 | 9/1976 | Jugle et al. | 430/110 |
| 4,019,911 | 4/1977 | Vijayendran et al. | 106/23 |
| 4,058,470 | 11/1977 | Moschovis et al. | 430/114 |
| 4,094,652 | 6/1978 | Lowther | 55/33 |
| 4,247,597 | 1/1981 | Russell | 430/110 |
| 4,460,476 | 7/1984 | McCaffrey et al. | 210/689 |

*Primary Examiner*—John D. Welsh

*Attorney, Agent, or Firm*—Robert A. Gerlach

[57] ABSTRACT

A method and apparatus for developing an electrostatic latent image on an electrographic element with a liquid developer by contacting the liquid developer with a molecular sieve zeolite.

17 Claims, 2 Drawing Figures

METHOD AND APPARATUS FOR DEVELOPING ELECTROGRAPHIC IMAGES USES MOLECULAR SIEVE ZEOLITE

FIELD OF THE INVENTION

This invention relates to electrography and more particularly to a method of development utilizing a liquid developer.

BACKGROUND OF THE INVENTION

Electrographic imaging and development processes have been extensively described in both the patent and other literature. Generally, these processes include the common steps of forming an electrostatic charge image, often called an electrostatic latent image, on an insulating surface, such as a photoconductive insulating layer coated on a conductive support. The electrostatic latent image is then rendered visible by a development step in which the charge image-bearing surface is brought into contact with a suitable elctrostatic image developer composition which deposits toner particles on either the charge or uncharged image areas. After development, the visible image is either fixed directly to the electrostatic charge-bearing surface or it is transferred to another surface, such as paper, where it is there fixed.

Liquid developer compositions of the type described, for example, in Metcalfe et al, U.S. Pat. No. 2,907,674, issued Oct. 6, 1959 have been used to develop latent electrostatic images. Such developers usually comprise a stable dispersion of charged particles, known as toner particles, comprising a pigment, such as carbon black, generally associated with the resinous binder, such as, an alkyd resin, dispersed in an electrically insulating liquid which serves as a carrier. A charge control agent is sometimes included to stabilize the magnitude and polarity of the charge on the toner particles. In some cases, the binder itself serves as a charge control agent.

U.S. Pat. No. 3,939,087 and No. 4,019,911 issued to Vijayendran et al recognize high humidity as a problem in obtaining good prints in electrophotography. These patents also teach the addition of highly hydrophobic agents, such as silane treated fumed silica to the liquid developer to help solve this problem as the silanes are not sensitive to humidity.

U.S. Pat. No. 4,058,470 issued to Moschovis et al also teaches the addition of hydrophobic colloidal silica to a liquid developer to increase the oleophilicity of the liquid developer.

Mayer U.S. Pat. No. 2,877,133 and No. 2,890,174 teach a liquid developer having silica aerogel mixed therein as a suspending agent for the opaque marking particles.

While high humidity conditions are detrimental to liquid electrographic developers generally in that the density of the developed image is decreased, more serious problems can be encountered as the developers become more complex. For example, in U.S. Pat. No. 3,788,995 issued to Stahly et al copolymers are described that stabilize both the dispersion of the toner particles in the carrier liquid and the charge. These copolymers contain hydrophilic polar groups which can ionize in the presence of ambient moisture to form ionic species that compete with charge toner particles for latent image sites, thus reducing image density.

In addition, certain colorants when added to liquid developers to impart a desired color to a finally developed image can increase the difficulties with regard to image densities under high humidity conditions. It is believed that these colorants contain a large number of hydrophilic groups which, increases the hydrophilicity of the medium in the presence of water, thus causing increased ionization of the hydrophilic polar groups present in the copolymers as previously discussed.

Regardless of the mechanism by which degradation of the finally developed image occurs, it is essential that the particular developer employed produce uniform images over extremely broad relative humidity conditions.

SUMMARY OF THE INVENTION

The present invention provides a method and apparatus for developing over a wide range of humidity conditions, an electrostatic charge pattern of an electrographic element with a liquid developer which is subjected to the action of a molecular sieve zeolite.

In accordance with the method of this invention, a body of molecular sieve zeolite particles or pellets are positioned in such a fashion that the liquid developer is subjected to the surface of the molecular sieve zeolite particles during the electrostatographic process. This is accomplished by establishing a zone wherein the zeolite is constrained, the zone being located such that the liquid developer is passed over the surface of the molecular sieve zeolite. In electrographic apparatus using a liquid development method, the developer is generally in a state of agitation. This condition can be taken advantage of in practicing the method of this invention by strategically locating the zone containing the molecular sieve zeolite where contact of the liquid developer and the molecular sieve particles will occur naturally as a matter of course when the apparatus is in operation. In this case, the action of the zeolite on the developer is on a continuous basis. The contact can also be accomplished on a repeated or intermittent basis by disposing the zone such that the liquid developer passes over molecular sieve zeolite particles only at certain times or under certain conditions.

DESCRIPTION OF THE DRAWINGS

The method and apparatus in accordance with this invention is now made with reference to the accompanying drawings wherein like reference numerals designate like parts and wherein.

DETAILED DESCRIPTION OF THE INVENTION

Figure 1:
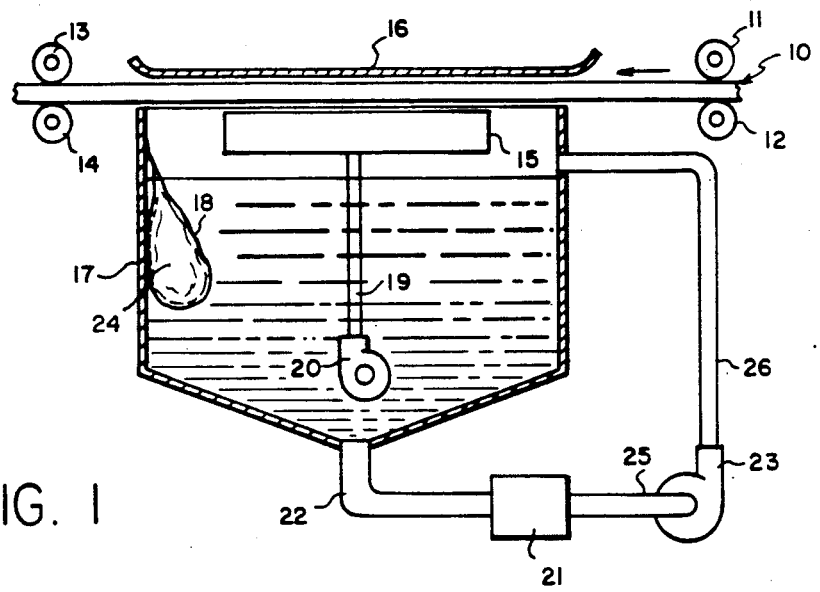
FIG. 1 is a schematic representation showing one embodiment in accordance with this invention.

With reference to FIG. 1, sheet or web 10 is an imaging element such as, for example, a photoconductive member which moves by two pairs of spaced rollers 11, 12 and 13, 14 into closely spaced relationship relative to an applicator head generally shown as numeral 15. This head 15 can be a multiple slit applicator head as described and claimed in U.S. Pat. No. 3,407,786 issued to Beyer and York Oct. 29, 1968. The imaging member 10 faces the applicator 15 and can be maintained in closely spaced relationship thereto by means of guide plate 16. The imaging member 10 is moved relative to applicator head 15 by means of the rollers shown or any other suitable method, in the direction shown by the arrow.

The applicator head 15 is positioned within the sump 17 which contains a liquid developer composition. Applicator head 15 is supplied with liquid developer by means of pump 20 through conduit 19. Positioned within the sump 17 and extending below the surface of the liquid developer is a container 18 in which a suitable molecular sieve zeolite 24 is disposed. Container 18 defines a zone through which liquid developer continuously passes due to the motion thereof caused by the action of pumps 20 and 23. The container 18 can be of any suitable material that will restrain the molecular sieve particles while permitting passage of the liquid developer. A nylon mesh bag having openings smaller than the particle size of the sieve is particularly convenient, however, any material that permits the flow of and is not subject to attack by the developer is satisfactory. Sump 17 is equipped with a recirculation system comprising conduit 22 which connects the sump to a filter 21. The filter 21 is for the purpose of filtering out large oversized particles from the liquid developer while permitting the components of the liquid developer including the toner particles contained therein to pass therethrough. Filter 21 is connected by means of conduit 25 to recirculation pump 23 which returns the developer to the sump 17 by conduit 26. The action of pumps 20 and 23 maintain the liquid developer in continuous motion and portions thereof are continuously passing through the zoner 18 of the molecular sieve zeolite.

Figure 2:
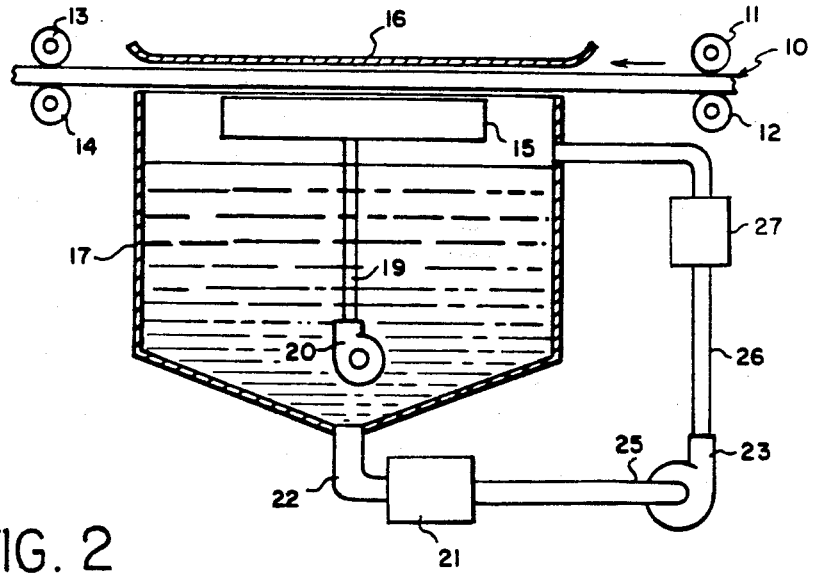
FIG. 2 is a schematic representation of a second embodiment in accordance with this invention.

FIG. 2 is similar to FIG. 1 except that in place of the molecular sieve being disposed in container 18, it is incorporated into the recirculation passage in container 27, that is, as shown, located substantially at the highest point of the recirculation system. As the liquid developer circulates from the sump 17 and back again by way of pump 23 and conduit 26 it passes through container 27 and is subjected to the action of the molecular sieve zeolite contained therein. The recirculation system may be operated continuously during operation of the apparatus or on an intermittent basis. For example, pump 23 may be cycled on and off for various time periods. Container 27 may be positioned at any location within the recirculation system, such as before or after filter 21, or after pump 23. However, it is preferred that container 27 be located above the lowest point in the recirculation system to prevent clogging of the pores of the molecular sieve particles with toner particles when the apparatus is not operating. Container means 27 may also be disposed in conduit 19 between pump 20 and applicator head 15. In this regard, the liquid developer contacts the molecular sieve zeolite particles only during the development step of the electrographic process. In fact, the molecular sieve zone may be positioned in any fashion within the development system as long as the liquid developer is moved past the molecular sieve thus being exposed to the action thereof.

Container 27 is provided with a means for restraining the molecular sieve therein while permitting the liquid developer, including the toner particles to pass through, such as, a fine screen having opening therein smaller than the particle size of the sieve material but large enough to permit passage by the developer.

Any suitable molecular sieve zeolite such as, for example, Type A, Type L, Type X, Type Y and mixtures of these zeolites may be used in this invention. The molecular sieve materials are crystalline, hydrated metal allumino-silicates which are either made synthetically or naturally occurring minerals. Such materials are described in U.S. Pat. Nos. 2,882,243, 2,882,244, 3,078,636, 3,140,235 and 4,094,652, all of which are incorporated herein by reference. In the practice of this invention the two types, A and X are preferred. Molecular sieve, zeolites contain in each crystal interconnecting cavities of uniform size, separated by narrower openings, or pores, of equal uniformity. When formed, this crystalline network is full of water, but with moderate heating, the moisture can be driven from the cavities without changing the crystalline structure. This leaves the cavities with their combined surface area and pore volume available for absorption of water or other materials. The process of evacuation and refilling the cavities may be repeated indefinitely, under favorable conditions.

With molecular sieves close process control is possible because the pores of the crystalline network are uniform rather than of varied dimensions, as is the case with other adsorbents. With this large surface area and pore volume, molecular sieves can make separations of molecules, utilizing pore uniformity, to differentiate on the basis of molecular size and configuration.

Molecular sieves are crystalline, metal aluminosilicates with three dimensional network structures of silica and alumina tetrahedra. This very uniform crystalline structure imparts to the molecular sieves properties which make them excellent desiccants, with a high capacity even at elevated temperatures. Some molecular sieves, in addition to this high adsorptive capacity, have the ability to indicate relative humidity by a change in color, which can be utilized to determine the point where reactivation is required. This feature is useful in the practice of this invention as the molecular sieve can be replaced when color change first becomes apparent. It may even be desirable to make the container 27 of a transparent material to permit viewing of the sieve.

The crystalline metal alumino-silicates have a three-dimensional interconnecting network structure of silica and alumina tetrahedra. The tetrahedra are formed by four oxygen atoms surrounding a silicon or aluminum atom. Each oxygen has two negative charges and each silicon has four positive charges. This structure permits a sharing arrangement, building tetrahedra uniformly in four directions. The trivalency of aluminum causes the alumina tetrahedron to be negatively charged, requiring an additional cation to balance the system. Thus, the final structure has sodium, potassium, calcium or other cations in the network. These charge balancing cations are the exchangeable ions of the zeolite structure.

In the crystalline structure, up to half of the quadrivalent silicon atoms can be replaced by trivalent aluminum atoms. Zeolites containing different ratios of silicon to aluminum ions are available, as well as different crystal structures containing various cations.

In the most common commercial zeolite, Type A, the tetrahedra are grouped to form a truncated octahedron with a silica or alumina tetrahedron at each point. This structure is known as a sodalite cage.

When soldalite cages are stacked in simple cubic forms, the result is a network of cavities approximately 11.5 A in size, accessible through openings on all six sides. These openings are surrounded by eight oxygen ions. One or more exchangeable cations also partially block the face area. In the sodium form, this ring of oxygen ions provides an opening of 4.2 A in diameter into the interior of the structure. This crystalline structure is represented chemically by the following formula:

$$Na_{12}[(AlO_2)_{12}]\times H_2O$$

The water of hydration which fills the cavities during crystallization is loosely bound and can be removed by moderate heating. The voids formerly occupied by this water can be refilled by adsorbing a variety of gases and liquids. The number of water molecules in the structure (the value of X) can be as great as 27.

The sodium ions which are associated with the aluminum tetrahedra, tend to block the openings, or conversely may assist the passage of slightly oversized molecules by their electrical charge. As a result, this sodium form of the molecular sieve, which is commercially called 4 A, can be regarded as having uniform openings of approximately 4 A diameter.

Because of their base exchange properties, zeolites can be readily produced with other metals substituting for a portion of the sodium.

Among the synthetic zeolites, two modifications have been found particularly useful in industry. By replacing a large fraction of the sodium with potassium ions, the 3 A molecular sieve is formed (with openings of about 3 A). Similarly, when calcium ions are used for exchange, the 5 A (with approximately 5 A openings) is formed.

The crystal structure of the Type X zeolite is built up by arranging the basic sodalite cages in a tetrahedral stacking (diamond structure) with bridging across the six-membered oxygen atom ring. These rings provide opening 9–10 A in diameter into the interior of the structure. The overall electrical charge is balanced by positively charged cation(s), as in the Type A structure. The chemical formula that represents the unit cell of Type X molecular sieve in the soda form is shown below:

$$Na_{86}[AlO_2)_{86}(SiO_2)_{106}]\times H_2O$$

As in the case of the Type A crystals, water of hydration can be removed by moderate heating and the voids thus created can be refilled with other liquids or gases. The value of X can be as great as 276.

A prime requisite for any adsorbent is the possession of a large surface area per unit volume. In addition, the surface must be chemically inert and available to the required adsorbate(s). From a purely theoretical point of view, the rate at which molecules may be adsorbed, other factors being equal, will depend on the rate at which they contact the surface of adsorbent particles and the speed with which they diffuse into partices after contact. One or the other of these factors may be controlling in any given situation. One way to speed the mass transfer, in either case, is to reduce the size of the adsorbent particles.

While the synthetic crystals of zeolites are relatively small, e.g., 0.1 μm to 10 μm, these smaller particles may be bonded or agglomerated into larger shapes. Typical commercial spherical particles have an average bonded particle size of 1000 μm to 5000 μm (4 to 12 mesh). Other molecular sieve shapes, such as pellets (1–3 mm diameter), Rashig rings, saddles, etc., are useful.

Any of the particular shapes set forth above are useful in accordance with this invention, however, those bonded shapes such as pellets, Rashig rings, saddles and the like are preferred as they are less inclined to becoming clogged with the toner particles present in the liquid developers. Also, they are more readily constrained within the zone, thus preventing the contamination of the liquid developer. Type 4 A molecular sieve zeolite bond agglomerates prepared in the shape of pellets having a particles size of 1000 to 5000 μm are most preferred in conducting the process in accordance with this invention.

As indicated above, the method in accordance with this invention is useful regardless of the particular liquid developer employed. In their most elementary form, liquid developers are made up of an insulating carrier liquid and a binder.

Suitable liquid carrier vehicles may be selected from a wide variety of materials which are electrically insulating and have a fairly low dielectric constant. The dielectric constant should be less than about 3 while the volume resistivity should be greater than about $10^{10}$ ohm/cm. Suitable carrier liquids include halogenated hydrocarbon solvents, for example, fluorinated lower alkanes, such as trichloromonofluoromethane, trichlorotrifluoroethane, etc., having a boiling range typically from about 2° to about 55° C. Other hydrocarbon solvents are useful, such as isoparaffinic hydrocarbons having a boiling range of from about 145° to about 185° C., such as Isopar G (a trademark of the Exxon Corporation) or cyclohydrocarbons, such as cyclohexane and cyclopentane. Additional carrier liquids may also be useful in liquid developer compositions including high polysiloxanes, odorless mineral spirits, n-hexane, octane and the like.

Any suitable binder material known in the liquid developer art may be employed in the process in accordance with this invention, such as, a wide range of materials including resins of the following type: polyethylene, phenol-formaldehyde, rosin modified phenol-formaldehyde, maleic rosin polyesters, soya-modified alkyd resins, modified pentaerythritol ester of rosin, maleic alkyl modified rosin esters, modified phenolic resins, soya oil and linseed oil modified alkyds, methylphenol-formaldehyde, xylenol-formaldehyde and any other resinous material set forth in U.S. Pat. No. 3,779,924 issued to Chechak. In addition, the binder materials may include any of those prepared in accordance with U.S. Pat. No. 4,052,325 to Santilli granted Oct. 4, 1977 which discloses certain polyester type resins for use as binders and also U.S. Pat. No. 4,202,785 to Merrill et al directed to a class of polyester ionomers as binders, all the above-mentioned patents being incorporated herein by reference as well as the compositions set forth therein. A particularly useful binder in the preparation of the liquid developers are those described and claimed in U.S. Pat. No. 3,788,995 issued to Stahly et al. This patent discloses random copolymers prepared from monomers having a predetermined relationship with the carrier liquid to be utilized in the liquid developer. At least one of the monomeric moieties of the copolymer is a polar moiety and at least one other of the monomeric moieties of the copolymer is one that is soluble in the carrier liquid of the developer. The copolymers employed are made up of at least two monomer units and may contain as many as 4 or even more different monomeric units. Examples of suitable copolymers include poly(styrene-co-lauryl methacrylate-co-sodium acrylate), poly(styrene-co-lauryl methacrylate-co-2-sulfoethyl methacrylate), poly(styrene-co-lauryl methacrylate-co-3-sulfopropyl methacrylate, sodium salt), poly(butyl methacrylate-co-lauryl methacrylate-co-2-sulfoethyl methacrylate), poly(ethyl methacrylate-co-lauryl methacrylate-co-2-sulfoethyl methacrylate), poly(t-butylstyrene-co-styrene-co-lithium sulfoethyl methacrylate), poly(t-butylstyrene-co-lithium methacrylate), poly(vinyltoluene-co-lauryl methacrylate-co-lithium methacrylate-co-methacrylic acid) and the like. These polymers are in many cases useful as binders as well as dispersing agents and charge-control agents to maintain the particles in suspension and to maintain constant charge on the particles, respectively. They may be used solely as the binder material, however, are generally utilized together with other polymers to impart desired characteristics.

Polyesters, such as those disclosed in U.S. Pat. Nos. 4,052,325 and 4,507,377 all of which are incorporated herein by reference are useful as binders in accordance with this invention.

As indicated previously, in their most elementary form, liquid developers comprise a liquid carrier vehicle together with a binder. However, as a practical matter, various additional materials are generally incorporated in present day commercial liquid developers.

While colorless images may be utilized for the preparation of a hydrophobic image for use in a lithographic printing process, generally a colorant is added to the binder to form toner particles.

When visible images are desirable, useful results are obtained from virtually any of the wide variety of known dyes or pigment materials. Particularly good results are obtained by using various kinds of carbon black pigments. A representative list of colorants may be found, for example, in *Research Disclosure,* Vol. No. 109, May, 1973 in an article entitled "Electrophotographic Elements, Materials and Processes".

Various charge control agents may also be incorporated in the liquid developer. In addition to the charge control polymers described in U.S. Pat. No. 3,788,995, other suitable charge control agents may be incorporated in the liquid developer, such as, for example, phosphonate materials described in U.S. Pat. No. 4,170,563, quaternary ammonium polymers described in U.S. Pat. No. 4,229,513 and metal salts as described in U.S. Pat. No. 3,417,019.

Waxes and dispersing agents for the wax are also included as optional disperse components in liquid developers. Suitable waxes and dispersing agents include those described in European Patent Application Publication Number 0 062 482 filed Mar. 30, 1982 which describes liquid electrographic developers comprising an electrically insulating organic carrier liquid containing dispersed constituents and dissolved constituents, the dissolved constituents comprising an electrically insulating organic dispersing liquid that forms a solution with the carrier liquid. The dispersed constituents include at least one thermoplastic resin and wax particles and a dispersing agent for the wax particles that is insoluble in the solution of carrier liquid and dispersing liquid, but soluble in the dispersing liquid alone. The wax particles are polyolefin wax, carnauba wax and ester wax or an amide wax. The dispersing liquid used with these waxes is preferably an alkylated aromatic liquid when the carrier liquid is a isoparaffinic hydrocarbon, such as Isopar G. Other suitable dispersing agents include copolymers of ethylene and vinylacetate marketed under the trademark Elvax by DuPont Company.

The invention is further illustrated by the following examples in which parts are by weight unless otherwise specified:

EXAMPLE 1

About 50 parts by weight of poly[neopentyl-4-methylcyclohexene-1,2-dicarbarboxylate-co-terephthalate-co-5-sodiosulfophthalate] 53/43/4, 25 parts of Bonadur Red, C. I. Pigment Red 200 (Sun Chemical Company) about 12.5 parts of a polyethylene wax (Epolene E-12 TM) Eastman Kodak Company) and about 12.5 parts of an ethylenevinylacetate copolymer 72/28 (Elvax 210) DuPont Company were first melt blended pulverized then dispersed in a sand mill in the presence of, about 50 parts of poly(t-butylstyrene-co-styrene-co-lithium sulfoethylmethacrylate) 72/24/4, and about 350 parts of poly Isopar G. After 6 hours milling 8 parts of (t-butylstyrene-lithium methacrylate) and about 282 parts of Isopar G ® were added to the mill and milling continued for 1 hour after which the dispersion was diluted with sufficient Isopar G to form a liquid developer containing 8 grams of dry toner per liter of developer.

EXAMPLE 2

The following ingredients were melt blended, pulverized and then dispersed in a sand mill for 6 hours.

| | |
|---|---|
| 50 | parts by weight of poly(neopentyl-4-methylcyclohexene-1,2-dicarboxylate-co-terephthalate-co-5-sodiosulfoisophthalate] |
| 20 | parts by weight of Regal 300 R carbon black (Cabot Carbon Co.) |
| 5 | parts by weight of Alkali Blue GG, CI 42750 (Sherwin Williams Co.) |
| 12.5 | parts by weight of Elvax 210 |
| 12.5 | parts by weight of Epolene E-12 |

in the presence of 100 parts of poly(t-butylstyrene-co-styrene-co-lithium sulfoethylmethylacrlate) 72/24/4 and 20 parts by weight of poly[isobutylmethacrylate-co-2-ethylhexylmethacrylate-co-divinyl benzene] 67/30/3 and 513 parts of Isopar G were added and milled for 6 hours. Finally 30 parts of poly(t-butylstyrene-lithium methacrylate) and 480 parts of Isopar G were added and milling continued for an additional hour. The dispersion was diluted with sufficient Isopar G to form an 8×developer (8 grams of dry toner per liter of developer)

EXAMPLE 3

The liquid developers of Examples 1 and 2 were employed to form images in a conventional electrophotographic device utilizing a color proofing element described in Example 1 of U.S. Pat. No. 4,600,669 issued July 15, 1986. Images were initially made under ambient conditions both with and without a one pound bag of molecular sieve zeolite type 4 A hanging in the sump as illustrated in FIG. 1. Secondly, images were made over a two week period in a controlled environment of 72% relative humidity with and without the presence of a molecular sieve zeolite. The density of the images produced were recorded. The results of these tests are set forth in the following table:

| | Image Transmission Density | |
|---|---|---|
| | Example 1 | Example 2 |
| Room Conditions without molecular sieve | 0.96 | 1.00 |
| Room Conditions | 0.93 | 0.98 |

-continued

| | Image Transmission Density | |
|---|---|---|
| | Example 1 | Example 2 |
| with molecular sieve | | |
| 72% RH without molecular sieve | 0.80 | 0.74 |
| 70% RH with molecular sieve | 0.95 | 0.95 |

It can be seen from this table that at high relative humidity the density of the image produced seriously drops off without the presence of the molecular sieve. The quality of the images at high relative humidity does not suffer in the presence of molecular sieve zeolite when compared with images produced with or without molecular sieve zeolite at normal room conditions of relative humidity.

EXAMPLE 4

A liquid developer was prepared as in Example 1 except that 25 parts of Rangoon Yellow (Sun Chemical Company) were used in place of 25 parts of Bonadur Red and final dilution was to 2.0 g of dry toner per liter of Isopar G. The water content of the developer after 24 hours at ambient RH was 48.3 parts per million and the transmission density 1.05. When 400 parts by volume of liquid developer were subjected to 10 parts of type 4 A molecular sieve zeolite the water content was 24 parts per million and the density 1.13. The same developer after 72 hours at 72% relative humidity with and without being subjected to the molecular sieve were 147.2 parts per million density 0.63 and 74.5 parts per million density 0.95, respectively.

It can readily be seen that the density of images at ambient and at 72% relative humidity when the developer is subjected to a type 4 A molecular sieve are comparable while that at high humidity without the use of the sieve is seriously degraded.

EXAMPLE 5

This example illustrates the effect of molecular sieves on the water content and charge of a combination of a carrier vehicle (Isopar G) and two liquid developer stabilizers, poly(t-butylstyrene-co-styrene-co-lithium sulfoethyl methacrylate) and poly(t-butylstyrene-co-lithium methacrylate).

Eight bottles, one each of Isopar G, a 0.8% solution of the terpolymer above in Isopar G, a 0.24% solution of the copolymer above in Isopar G and a mixture of all three are treated as follows: one bottle of each is permitted to stand;

(1) at room conditions (about 40% RH)
(2) at room conditions over 2.4 grams of a type 4 A molecular sieve zeolite per 17 ml of Isopar G
(3) at 72% relative humidity
(4) at 72% relative humidity over a type 4 A molecular sieve zeolite.

The water contents in parts per million of the various solutions and the charge per unit volume (μcoulombs/cc) are shown in the following table:

| | Water Content (PPM)/Q/V (μ coulombs/ml) | | | |
|---|---|---|---|---|
| Conditions | Isopar G | 0.8% terpolymer in Isopar G | 0.24% copolymer in Isopar G | Isopar G + terpolymer + copolymer |
| Room | 21.6/0 | 62.5/0.19 | 33.2/4.5 | 72.6/4.9 |
| Room + | 12.7/0 | 25.5/0.12 | 18.9/3.8 | 39/5.2 |

-continued

| | Water Content (PPM)/Q/V (μ coulombs/ml) | | | |
|---|---|---|---|---|
| Conditions | Isopar G | 0.8% terpolymer in Isopar G | 0.24% copolymer in Isopar G | Isopar G + terpolymer + copolymer |
| molecular sieve | | | | |
| 72% RH | 37.2/0 | 154.5/1.1 | 57.9/2.7 | 199.3/7.4 |
| 72% RH + molecular sieve | 21.1/0 | 45.2/0.2 | 22.5/3.2 | 66.7/5.7 |

It has been found that molecular sieve zeolite particles are particularly useful in controlling the charge of liquid developers under varying humidity conditions. Other known desiccants are unsuitable for one or more reasons: (1) either they do not have the desired effect on the system of maintaining a uniform charge over widely varying conditions, (2) they cannot be easily prevented from escaping the contact zone and quickly become impurities in the developer or (3) they quickly become clogged with toner particles.

Although the invention has been described in considerable detail with particular reference to certain preferred embodiments thereof, variation and modifications can be effected within the spirit and scope of the invention.

I claim:

1. In a method of developing an electrostatic charge pattern on the surface of an electrographic element with a liquid developer, the improvement which comprises contacting the liquid developer with a molecular sieve zeolite.

2. The method of claim 1 wherein the liquid developer is passed through a zone containing molecular sieve zeolite particles.

3. The method of claim 2 wherein the molecular sieve zeolite particles are restrained within the zone.

4. The method of claim 1 wherein the liquid developer is continuously passed through the zone containing molecular sieve zeolite particles.

5. The method of claim 1 wherein the liquid developer is intermittently passed through the zone containing molecular sieve zeolite particles.

6. The method of claim 1 wherein the molecular sieve zeolite is selected from the group consisting of Type A and Type X molecular sieve zeolites.

7. The method of claim 6 wherein the molecular sieve zeolite is a Type A molecular sieve zeolite.

8. The method of claim 6 wherein the molecular sieve zeolite is a Type X molecular sieve zeolite.

9. The method of claim 1 wherein the liquid developer comprises an insulating carrier liquid.

10. The method of claim 1 wherein the liquid developer includes an insulating carrier liquid, a binder, a colorant and a charge control agent.

11. The method of claim 1 wherein the liquid developer available for use in developing the electrostatic charge pattern is recirculated through a zone of molecular sieve zeolite particles.

12. The method of claim 1 wherein the molecular sieve zeolite particles are bonded agglomerates of 1000 to 5000μ.

13. An apparatus for developing an electrostatic latent image on an electrographic element which comprises a sump for housing a quantity of liquid developer, an applicator head for applying the liquid developer to the surface of the electrographic element, a means for delivering the liquid developer from the sump to the applicator head and a means for contacting the liquid developer with a molecular sieve zeolite.

14. The apparatus of claim 13 wherein the means for passing the liquid developer over a molecular sieve zeolite includes a pervious bag containing molecular sieve zeolite particles, said bag disposed within the sump.

15. The apparatus of claim 13 wherein the means for passing the liquid developer over a molecular sieve zeolite includes a liquid developer recirculation means at least a portion of which contains molecular sieve zeolite particles.

16. The apparatus of claim 13 wherein the means for contacting the liquid developer with a molecular sieve zeolite is located above the lowest level of the liquid development system.

17. The apparatus of claim 13 wherein the means for contacting the liquid developer with a molecular sieve zeolite is located substantially near the top of the sump.

* * * * *